US011583016B2

(12) United States Patent
Armstrong

(10) Patent No.: US 11,583,016 B2
(45) Date of Patent: Feb. 21, 2023

(54) MOTORCYCLE HAND SIGNAL GLOVE

(71) Applicant: John Curtis Armstrong, Texas City, TX (US)

(72) Inventor: John Curtis Armstrong, Texas City, TX (US)

( * ) Notice: Subject to any disclaimer, the term of this patent is extended or adjusted under 35 U.S.C. 154(b) by 0 days.

(21) Appl. No.: 17/577,679

(22) Filed: Jan. 18, 2022

(65) Prior Publication Data

US 2022/0264975 A1 Aug. 25, 2022

Related U.S. Application Data

(60) Provisional application No. 63/152,606, filed on Feb. 23, 2021.

(51) Int. Cl.
*A41D 19/00* (2006.01)
*A41D 19/015* (2006.01)

(52) U.S. Cl.
CPC ..... *A41D 19/0024* (2013.01); *A41D 19/0157* (2013.01)

(58) Field of Classification Search
CPC ..... A41D 19/0024; A41D 19/0157
See application file for complete search history.

(56) References Cited

U.S. PATENT DOCUMENTS

2017/0188643 A1* 7/2017 Peifer ..... A41D 19/0051
2017/0295869 A1* 10/2017 Choi ..... A41D 19/01523
2020/0352264 A1* 11/2020 Fugate ..... A41D 19/0024

* cited by examiner

*Primary Examiner* — Thomas M Sember

(57) ABSTRACT

A motorcycle rider hand signal glove that promotes safe visible hand signals while riding singly or in a group and does not require any form of electrical power is disclosed. I do not know of any other item that exist that compares to my motorcycle hand signal glove.

7 Claims, 1 Drawing Sheet

MOTORCYCLE HAND SIGNAL GLOVE

CROSS-REFERENCE TO RELATED APPLICATIONS

This application claims the benefit of U.S. Provisional Patent Application with application No. 63/152,606, filed on Feb. 23, 2021, by John Armstrong. The application is entitled "Motorcycle Hand Signal Glove".

FEDERALLY SPONSORED RESEARCH

Not applicable

SEQUENCE LISTING OR PROGRAM

Not applicable

FIELD OF INVENTION

This application relates to a light reflective motorcycle hand signal glove to be worn by the motorcycle rider and to be used by the rider in concert with standard motor vehicle hand signals while riding a motorcycle in low light or dark conditions.

This invention relates to its ability to be used in concert with other motorcycle gloves or without any other hand covering at all. This is possible due to the specific way the glove is constructed with a stretchy light reflective material and only having two fingers, the small finger, and the index finger.

BACKGROUND OF THE INVENTION

In situations where the motorcycle rider is traveling with a group of other motorcyclists it is customary for one rider in the front of the group to provide standard vehicular hand signals to the other riders behind. The riders behind the lead motorcycle then proceed to utilize the same hand signal and provide the same information to the riders behind them. This works to provide a consistent and uniform set of instructions pertaining to the changing of lanes or the need to slow down or stop the lead motorcycle and the motorcycles behind the lead motorcycle. This is especially important when multiple motorcycles are traveling in a group and experiencing low light or dark conditions. The safety of the group depends on the successful conveyance of the proper hand signals throughout the group.

If the motorcycle rider is riding singly and in low light or dark conditions, it is often advantageous to utilize standard vehicular hand signals to indicate the intentions of the motorcycle rider to other vehicles in the area surrounding the rider.

The act of relaying hand signals is intended to allow a single rider or multiple riders to safely pilot their vehicles, namely motorcycles, in and around other vehicles along a roadway while communicating the desired operation of the lead motorcycle or the single rider.

I do not know of any other item that exist that compares to my motorcycle hand signal glove.

As far as is known there is no other motorcycle hand signal glove specifically designed for use by the motorcycle rider. It is believed that this product is unique in its design and functionality. A novelty search revealed:

A U.S. Patent Application Publication No. US 2020/0352264 A1 for a SPECIAL SAFETY SIGNALING GLOVES FOR A MOTORCYCLE PASSENGER and pertains to a pair of signal gloves to be used by the motorcycle passenger.

A U.S. Pat. No. 6,006,357 for a SIGNALING GLOVE which is comprised of a pair of fingerless gloves that require a dependent power source to provide the luminance.

SUMMARY OF INVENTION

Although most modern motorcycles have factory installed turn and stop lamps, the act of using standard vehicular hand signals to signal those around the rider is often more pronounced than a standard electronic signal.

These hand signals are to be conveyed to others by the rider of the motorcycle and not the passenger as the rider is the person that is controlling the speed and the direction of travel of the motorcycle.

When riding at night or in low light conditions it is difficult for other motorcycle riders or vehicles to see hand signals being used by the motorcycle rider. This invention allows a motorcycle rider to convey the hand signals in low light or dark conditions without any dependent light source as the reflective material it is constructed of will provide the luminance required while in traffic.

This invention eliminates the need for the motorcycle rider to have multiple signal gloves for varying weather conditions. In cold conditions a thicker, warmer glove may be worn underneath this invention. In warmer conditions a thinner glove may be worn underneath this invention. In optimal weather conditions this invention may be worn without any other hand covering. This allows for versatility in its use.

This invention is a singular left hand signaling glove for use by the motorcycle rider to convey the intent to change lanes, slow down or stop the motorcycle or motorcycles involved in riding on a street or highway in low light or dark conditions. The design of this invention allows its use in conjunction with other motorcycle gloves or with no other glove at all. This allows for versatility of use and ensures that the motorcycle hand signal glove can be worn in many weather conditions.

DETAILED DESCRIPTION

Figure 1:
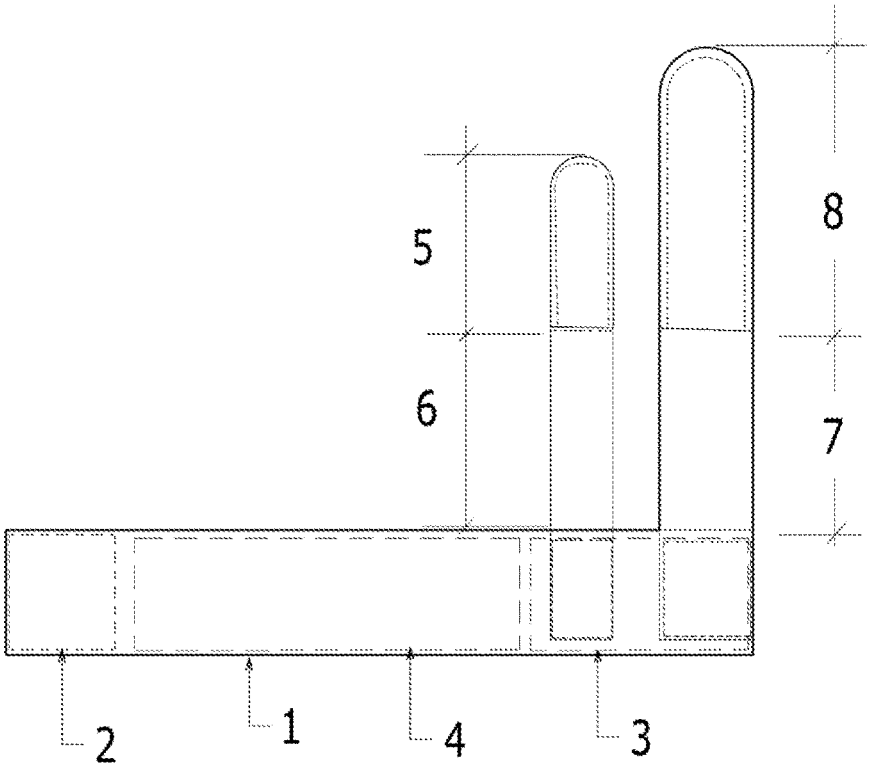
FIG. 1 a top view structural drawing.
Figure 2:
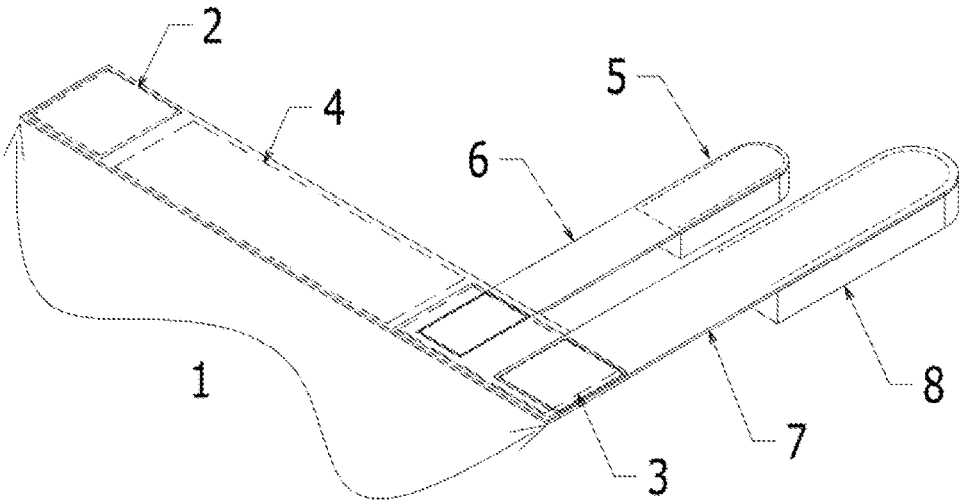
FIG. 2 an isometric view structural drawing.

FIG. 1 and FIG. 2 show a detailed embodiment of the disclosure, wherein FIG. 1 is a top structural view diagram and FIG. 2 is an isometric structural view diagram.

With reference to FIG. 1 and FIG. 2 a Motorcycle Hand Signal Glove comprises a non-light reflective two-inch-wide elastic wrist band 1 with a loop portion 2 attached to the bottom and a hook portion 3 attached to the top to allow for securing and adjusting the wrist band 1. A portion of stretchy light reflective material 4 is attached to the top of wrist band 1 between loop portion 2 and hook portion 3 and covering the width of wrist band 1.

A flat portion of stretchy non-light reflective material or stretchy light reflective material 6 attaches between wrist band 1 and stretchy light reflective material 5 with stretchy light reflective material 5 encapsulating the small finger of the left hand. A flat portion of stretchy light reflective material 7 attaches to wrist band 1 and continues to the tip of the index finger at which point it encapsulates the left-hand index finger 8.

Using the right hand, the index finger sleeve of the motorcycle hand signal glove is placed over the left index finger. The small finger sleeve is then placed over the left small finger. Using your right hand, you can then secure the hook and loop fastener on the elastic wrist strap.

This invention is a singular left hand signaling glove for use by the motorcycle rider to convey the intent to change lanes, slow down or stop the motorcycle or motorcycles involved in riding on a street or highway in low light or dark conditions.

Motorcycle hand signals are to be conveyed to others by the rider of the motorcycle and not the passenger as the rider is the person that is controlling the speed and the direction of travel of the motorcycle.

The motorcycle hand signal glove can be worn on the bare hand or over your choice of additional leather or fabric gloves. The stretchy light reflective material and the elastic wrist band allows the motorcycle hand signal glove to accommodate most glove sizes and thicknesses so the motorcycle hand signal glove can be worn in a variety of weather conditions.

Although most modern motorcycles have factory installed turn and stop lamps, the act of using standard vehicular hand signals to signal those around the rider is often more pronounced than a standard electronic signal.

While riding a motorcycle and using standard hand signaling practices your left hand will be clearly visible in low light, rainy or dark conditions making it much easier for your signals to be seen by others while changing lanes or stopping et cetera.

The invention claimed is:

1. A motorcycle hand signal glove configured to be used by a rider of a motorcycle comprising an adjustable non-reflective elastic wrist portion with a stretchable light reflective portion attached to an outside thereof, a light reflective stretchable index finger of the rider portion connecting to the wrist portion and encapsulating an index finger and a two-piece small finger portion that connects to the wrist portion with a non-reflective elastic band and also encapsulates a small finger of the rider with a light reflective stretchable portion; wherein the glove is configured to only be used on the left hand of the motorcycle rider so in low light or dark traveling conditions the motorcycle rider can safely convey and alert others of the rider's intent to change lanes, turn left or right, slow down or stop.

2. The motorcycle hand signal glove as claimed in claim 1 wherein the glove includes two distinct finger portions and one distinct wrist portion.

3. The motorcycle hand signal glove as claimed in claim 1 wherein the light reflective material provided is stretchable.

4. The motorcycle hand signal glove as claimed in claim 1 wherein the wrist portion is comprised of a non-reflective elastic band which will encircle the wrist of the rides and include a hook and loop fastener system that makes this wrist portion adjustable.

5. The motorcycle hand signal glove as claimed in claim 4 wherein the wrist portion has a light reflective material attached to a top of the elastic band that will encircle the wrist of the rider.

6. The motorcycle hand signal glove as claimed in claim 1 wherein the index finger portion has a light reflective material that extends from the wrist portion, across a back of the left hand of the rider and onto the index finger with the light reflective material encapsulating the index finger of the rider.

7. The motorcycle hand signal glove as claimed in claim 1 wherein the small finger of the rider portion is comprised of two parts with the small finger being encapsulated in the stretchable light reflective material and a portion across a back of the left hand of the rider attached between the small finger portion and the wrist portion comprised of an elastic band that is not light reflective.

* * * * *